US005176760A

United States Patent [19]

Young

[11] Patent Number: 5,176,760

[45] Date of Patent: Jan. 5, 1993

[54] STEEL ARTICLE AND METHOD

[76] Inventor: Albert Young, 2249 E. Mallard Ct., Gilbert, Ariz. 85234

[21] Appl. No.: 796,633

[22] Filed: Nov. 22, 1991

[51] Int. Cl.[5] ..... C23C 8/26; C23C 8/36

[52] U.S. Cl. ..... 148/222; 148/228; 148/226; 148/318; 148/900

[58] Field of Search ..... 148/900, 318, 12.1, 148/16.6, 226, 228, 222; 204/177

[56] References Cited

U.S. PATENT DOCUMENTS 4,212,687 7/1980 Tanaka et al. ..... 148/16.6

FOREIGN PATENT DOCUMENTS 53-1143 1/1978 Japan ..... 148/16.6
53-83939 7/1978 Japan ..... 148/16.6
53-131237 11/1978 Japan ..... 148/16.6
2125861 5/1990 Japan ..... 148/16.6
2294463 12/1990 Japan ..... 148/16.6

*Primary Examiner*—Deborah Yee
*Attorney, Agent, or Firm*—Schmeiser, Morelle & Watts

[57] ABSTRACT

A hard wear-resistant and corrosion- and oxidation-resistant stainless steel article is made by precision machining a work piece of approximately the size and shape of the desired article, then subjecting the resulting cold worked article to ion bombardment until the article is nitrided to a depth of about 0.002 inch, and finally subjecting the nitrided article to an atmosphere of argon and nitrogen and oxygen until the resulting ion bombardment has penetrated to a depth in the article surface of about 0.0001 inch.

8 Claims, 1 Drawing Sheet

STEEL ARTICLE AND METHOD

FIELD OF THE INVENTION

The present invention relates generally to the ion nitriding art, and is more particularly concerned with a new ion nitriding method and with ion nitrided articles of unique hardness and wearability and those same articles having superior resistance to corrosion and oxidation.

BACKGROUND OF THE INVENTION

When it was thought that the hardness and wear resistance of stainless steels might be substantially improved by ion nitriding, many attempts were made to gain that important advantage. It eventually developed, however, that such improvement of mechanical properties was only marginal as a practical matter and, moreover, was at the expense of a substantial measure of stainless steel corrosion resistance. As a consequence, industrial use of ion nitriding has been limited and the special requirements of jet engine builders for stainless steel components of improved performance have gone unmet.

SUMMARY OF THE INVENTION

In accordance with the present invention, based upon the discoveries and new concepts set out below, stainless steel articles of unique hardness and wear resistance can be produced. Further, these products can be consistently provided in a form having superior resistance to corrosion and oxidation. The method for producing these novel articles is likewise new in the art in respect both to the series of steps resulting in the novel mechanical properties and the additional step resulting in the corrosion resistance properties. Thus, as the method of this invention is carried out to full extent, the end product stainless steel article is unique in respect both to mechanical properties and corrosion resistance properties and is qualified far above stainless steel articles known heretofore for purposes and applications involving jet engines.

A major discovery underlying this invention is that the condition of the surface of a stainless steel article is critically important. Specifically, I have found that the surface must be such that ion nitriding bombardment results in uniform penetration of the article to a depth of the order of at least 0.001 inch.

Additionally, I have found that such a receptive surface can consistently be provided by precision machining, that is, light stress machining the article just prior to the ion nitriding step. Particularly good results are obtained when such machining is done following a heat treatment step to relieve residual cold work stresses in the article.

Finally, without diminishing the hardness or wear resistance of the resulting ion nitrided article, its resistance to corrosion and oxidation is increased to a level well above that known in the prior art by subjecting the ion nitrided article to an atmosphere of argon, nitrogen and oxygen under an RF electrical potential and glow discharge until bombardment has penetrated to a depth in the article surface of at least about 0.0001 inch.

Briefly described, the method of this invention comprises steps of providing a stainless steel article of approximate desired size and shape and precision machining it to ultimate desired size and shape, then subjecting the resulting cold worked article to ion bombardment and electrical glow discharge under an atmosphere of hydrogen and nitrogen at pressure between about one and seven Torr and elevated temperature until the article is nitrided substantially uniform to depth between about 0.0001 and 0.003 inch. As an additional step, the ion nitrided article is subjected to an atmosphere of argon, nitrogen and oxygen at about 0.01 Torr under glow discharge until the ion bombardment is penetrated to a depth in the article surface at least about 0.0001 inch.

A novel article this invention has unique hardness and wear resistance properties as produced in the first steps of the process, and is also the article produced by the overall process including final method step and consequently also having unique resistance to corrosion and oxidation.

BRIEF DESCRIPTION OF THE DRAWINGS

Those skilled in the art we will gain a further and better understanding of this invention from the drawings accompanying and forming a part of this specification, in which.

DETAILED DESCRIPTION OF THE INVENTION

Figure 2:
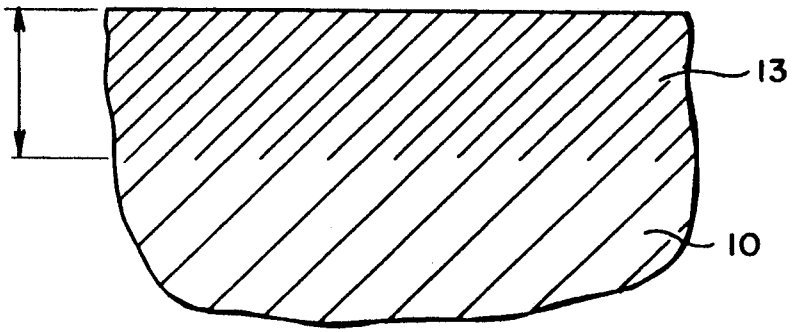
FIG. 2 is an enlarged fragmentary view of an article of this invention showing the primary ion nitrided surface region.
Figure 3:
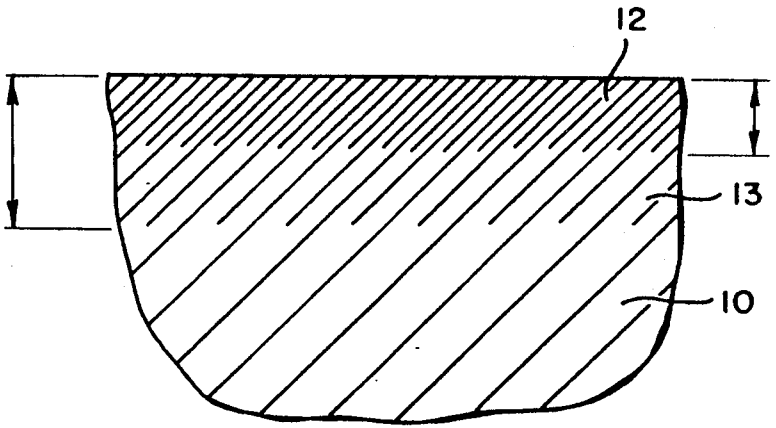
FIG. 3 is a view like that of FIG. 2 of the article of this invention subjected to the secondary ion bombardment step and consequently having the superior corrosion resistance properties described above.
Figure 1:
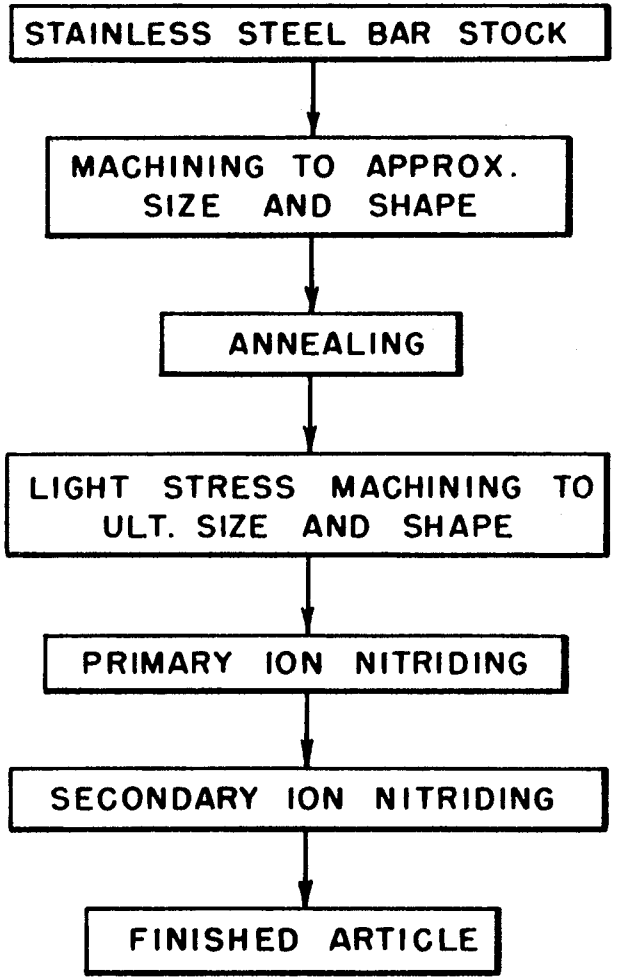
FIG. 1 is a flow diagram of the process of this invention.

In presently preferred practice of this invention, a stainless steel article of approximate desired size and shape is precision machined to ultimate desired size and shape. This light stress machining operation is followed by an ion nitriding step, an optional intervening heat treating operation being omitted in the best present practice. As indicated above, because of the condition of the lightly machined surface of article 10, penetration of the ion bombardment indicted at 11 is substantially deeper than that achieved in accordance with prior practice involving the ion nitriding of more heavily cold worked stainless steel bodies. As a consequence, ion nitrided article 10 has hardness and wear resistance properties much superior to those of the best of the prior art practice and consequently fully satisfies jet engine manufacturer requirements.

Article 10 is then—without further treatment or preparation —subjected to a secondary ion nitriding step under conditions which result in penetration of ion bombardment to shallower depth 12 in the substrate surface, suitably approximately one tenth of primary ion bombardment depth 11. The resulting product has corrosion and oxidation resistance substantially greater than that of the best ion nitrided stainless steels of the prior art.

In regard to the materials aspect of this invention, it will be understood that new results and advantages of the invention can be consistently gained and obtained with stainless steels generally and with other ferrous metal alloys which are subject to case hardening treatment of the ion nitriding type conducted in the manner of the practice described herein and variations thereof not presently preferred but within the scope of the present invention and the appended claims. As indicated above, however, the stainless steel alloys of choice are those used generally in providing jet engine components, those being the products facing special hardness, wear resistance and corrosion and oxidation resistance requirements. They are nickel-chromium alloy steels which, when treated in accordance with the preferred practice of this invention, have in addition good lubricity.

In regard to the ion nitriding process of this invention, in the initial stage it will be carried out at a temperature in the range of 800° to 1200° F. in a hydrogen-nitrogen atmosphere in proportion of one to ten parts of hydrogen to one part of nitrogen. The pressure of the hydrogen-nitrogen atmosphere will be about 1-7 Torr and the electric potential will be in the range of 400 to 600 volts DC. The depth of ion penetration will be from 0.001-0.003 inch and the time required depends upon the prevailing conditions, but will be long enough to provide the required ion penetration depth.

The secondary ion nitriding operation is conducted under an atmosphere of argon, nitrogen and oxygen of the order of 0.01 Torr at elevated temperature from a peak of 1500-2000 volts EMF modulated at 13.56 mHz and 15-25 amperes until this secondary ion penetration reaches depth of the order of 0.0001 inch or more, as desired.

The following illustrative, but not limiting, examples of the preferred practice of this invention as it has actually been carried out in production operations will serve to further instruct those skilled in the art concerning the details of the several steps of this new process and the unique characteristics of the resulting products.

EXAMPLE I

Bar stock of A286 stainless steel was cut and rough machined to provide a jet engine shaft bushing of approximate size and shape of the desired ultimate article, this alloy being of the following composition:

A 286 Stainless Steel

Ni: 25%
Cr: 16%
Mo: 1.2%
Ti: 2.12%
Al: 0.22%
V: 0.24%
Fe: Bal.

After annealing to relieve residual cold work stress, the article was subjected to precision machining to bring it to ultimate desired size and shape within specified tolerances, this operation involving only light work much diminished from that of the rough machining step. The precision-machined article was then subjected to depassivation treatment by heating for one hour from initial temperature of 300° F. to final temperature of 975°-1000° F. under a 5-7 Torr atmosphere of pure hydrogen. Voltage applied throughout the period was in the range of 400-500DC and current was 15-25 amperes. Immediately thereafter the resulting depassivated article was subjected in the same treatment vessel to ion nitriding for 36 hours during which a 75% hydrogen and 25% nitrogen atmosphere of one Torr was maintained. The temperature in the ion nitriding chamber throughout the operation was 975°-1000° F. while electrical glow discharge and ion bombardment continued under DC potential of 400 to 600 volts and current from 15-25 amperes. At the end of this 37-hour period, the article was removed from the chamber and cooled to room temperature and examined and tested. Ion nitriding depth was found to be uniformly approx. 0.002 inch. Hardness and wear resistance tests were conducted with the results stated above.

The article was then subjected to the secondary ion nitriding operation in which the atmosphere was argon, nitrogen and oxygen in approximately equal proportions and the pressure of the gases in the chamber was maintained throughout at 0.01 Torr. The temperature in the chamber was 900° F. throughout the operation, but in this instance the electrical potential was 1500-2000 volts modulated at 13.56 mHz and the current was 15-25 amperes. At the end of one hour, the operation was complete and the article was removed and after cooling to room temperature was examined and tested as described above. Ion penetration was uniform over the article and measured at 0.0001 inch, and the hardness and wear resistance were found to be substantially the same as that of the primary ion nitrided article stated above. Corrosion and oxidation resistance tests were then carried out at 1200° F. in the air, in salt fog at room temperature, and at 1200° F. in salt fog. In all instances, the product exhibited excellent corrosion resistance.

Example II

In another test like that described in Example I, a stainless steel alloy (17-4PH of composition set out below) which nitrides more easily than the A286 alloy of Example I, was subjected to the same procedures and conditions as those described in Example I. The results obtained were substantially identical to those reported above.

17-4PH Stainless Steel

Ni: 4%
Cr: 16.6%
Cu: 4%
Al: 1.1%
Fe: Bal.

Having thus described this invention so that others skilled in the art can understand and practice the same, I state that while I desire to secure by Letters Patent as set forth in what is claimed.

1. The method of producing a steel article of unique hardness and wearability which comprises the steps of providing a steel article of approximate desired size and shape, precision machining the article to ultimate desired shape and size, then subjecting the resulting cold worked article to an ion bombardment and electrical glow discharge phenomena under an atmosphere of hydrogen and nitrogen at pressure of between about one and seven Torr at elevated temperature until the article is nitrided to a depth of about 0.001 to 0.003 inch.

2. The method of claim 1 in which the temperature of the atmosphere is maintained at between about 900° and 1000° F. and in which DC voltage of 400-600 and amperage of 15-25 is impressed upon the system throughout the period of ion bombardment and electrical glow discharge treatment.

3. The method of claim 1 in which in precision machining the article the surface is removed to a depth of between about 0.004 and 0.006 inch.

4. The method of claim 3 in which the surface on each side of the article is removed substantially in uniformly to a depth between about 0.004 and 0.006 inch.

5. The method of claim 1 including the step of subjecting the nitrided article to ion bombardment and electrical glow discharge under an atmosphere of argon, nitrogen and oxygen at 0.01 Torr from a peak of 1500-2000 volts EMF modulated at 13 mHz and 15-25 amperes until the ion bombardment has penetrated to a depth in the article surface at least about 0.0001 inch.

6. The method of producing a stainless steel article of unique hardness and wearability which comprises the steps of providing a stainless steel article of approximate desired size and shape, removing a portion of the article surface to a depth at least about 0.001 inch, then depassivating the resulting cold worked article by heating it in hydrogen for about 300° F. to about 1000° F. in about 1 hour under a pressure of 5-7 Torr at voltage 400-500 and 15-25 amperes and ion nitriding the article by subjecting it to ion bombardment and glow discharge for 36 hours under an atmosphere of 75% hydrogen 25% nitrogen and 5-7 Torr pressure at 975°-1000° F. and 380-400 volts DC and 15-25 amperes.

7. The method of claim 6 including the step of subjecting the ion nitrided article to ion bombardment and electrical glow discharge under an atmosphere of argon, nitrogen and oxygen at 0.01 Torr from a peak of 1500-2000 volts EMF modulated at 13.56 mHz and 15-25 amperes until the ion bombardment has penetrated to a depth in the article surface at least about 0.0001 inch.

8. A stainless steel article having a unique combination of superior hardness and wearability and resistance to corrosion and oxidation, said article having a nitride surface portion composed of a primary nitride phase of uniform depth about 0.002 inch and a secondary nitride phase of uniform depth about 0.0001 inch.

* * * * *